US009273941B2

(12) United States Patent
Carlson et al.

(10) Patent No.: US 9,273,941 B2
(45) Date of Patent: Mar. 1, 2016

(54) COMBINATION GAS OPERATED RIFLE AND SUBSONIC CARTRIDGE

(71) Applicant: Alliant Techsystems Inc., Minneapolis, MN (US)

(72) Inventors: Erik K. Carlson, Oak Grove, MN (US); Richard D. Hurt, Anoka, MN (US); Drew Goodlin, Isanti, MN (US); Lawrence P. Head, Cambridge, MN (US)

(73) Assignee: Vista Outdoor Operations LLC, Clearfield, UT (US)

( * ) Notice: Subject to any disclaimer, the term of this patent is extended or adjusted under 35 U.S.C. 154(b) by 0 days.

(21) Appl. No.: 14/216,386

(22) Filed: Mar. 17, 2014

(65) Prior Publication Data

US 2014/0311332 A1 Oct. 23, 2014

Related U.S. Application Data

(60) Provisional application No. 61/791,807, filed on Mar. 15, 2013.

(51) Int. Cl.
*F42B 5/045* (2006.01)
*F41A 5/18* (2006.01)

(52) U.S. Cl.
CPC .. *F42B 5/045* (2013.01); *F41A 5/18* (2013.01)

(58) Field of Classification Search
CPC ..... F41A 5/18; F42B 5/045
USPC ..... 102/433, 434; 89/191.01
See application file for complete search history.

(56) References Cited

U.S. PATENT DOCUMENTS

| | | | | |
|---|---|---|---|---|
| 389,496 | A | 9/1888 | Brown | |
| 390,232 | A * | 10/1888 | Hurst | 102/443 |
| 504,736 | A | 9/1893 | Maxim | |
| 1,812,010 | A | 6/1931 | McBride | |
| 3,134,330 | A * | 5/1964 | Batou | 102/376 |

(Continued)

FOREIGN PATENT DOCUMENTS

| | | |
|---|---|---|
| CA | 2173968 | 4/1995 |
| FR | 78417 | 7/1962 |

OTHER PUBLICATIONS

International Search Report dated Oct. 16, 2014 for PCT Application No. PCT/US2014/028378, filed Mar. 14, 2014, 4 pgs.

(Continued)

*Primary Examiner* — Bret Hayes

(57) ABSTRACT

A method of operating a gas operated automatic or semi-automatic weapon that has a bolt that locks by a partial rotation of the bolt with respect to a bolt carrier, the bolt carrier in communication with a gas port on the barrel of the weapon, the method comprising utilizing the gas pressure from a cartridge received from a port in the barrel to unlock the bolt, and utilizing the expansion of a telescoping cartridge in the chamber to recycle the weapon after the bolt is unlocked. In embodiments the cartridge is a 5.56 mm cartridge. In embodiments, the propellant driving the projectile does not provide enough gas pressure to recycle the weapon and the telescoping cartridge supplements the needed power for recycling sufficient to accomplish the recycling. The invention include the telescoping cartridge providing a projectile with lethal energy and recycle capability for gas operated rifles. The subsonic cartridge may have at least 80 ft lbs of energy and operates subsonically.

11 Claims, 7 Drawing Sheets

(56) References Cited

U.S. PATENT DOCUMENTS

| | | | | | |
|---|---|---|---|---|---|
| 3,176,617 | A | | 4/1965 | Brafford | |
| 3,712,225 | A | | 1/1973 | Nimylowycz | |
| 3,738,272 | A | * | 6/1973 | Grosbard | 102/376 |
| 4,197,801 | A | * | 4/1980 | LaFever et al. | 102/433 |
| 4,335,657 | A | * | 6/1982 | Bains | 102/433 |
| 4,593,622 | A | | 6/1986 | Fibranz | |
| 4,604,954 | A | * | 8/1986 | Clarke et al. | 102/434 |
| 4,674,405 | A | | 6/1987 | Brede et al. | |
| 4,823,699 | A | | 4/1989 | Farinacci | |
| 4,938,145 | A | | 7/1990 | Martwick | |
| 5,016,536 | A | * | 5/1991 | Brighton | 102/430 |
| 5,029,530 | A | * | 7/1991 | Martwick et al. | 102/434 |
| 5,048,422 | A | | 9/1991 | Northrup et al. | |
| 5,048,423 | A | * | 9/1991 | Garrett | 102/434 |
| 5,062,366 | A | * | 11/1991 | Candland et al. | 102/430 |
| 5,067,408 | A | | 11/1991 | Martwick | |
| 5,192,829 | A | | 3/1993 | Suire | |
| 5,355,764 | A | | 10/1994 | Marinos et al. | |
| 5,359,937 | A | | 11/1994 | Dittrich | |
| 5,429,030 | A | | 7/1995 | Tidman | |
| 5,492,063 | A | | 2/1996 | Dittrich | |
| 5,677,505 | A | | 10/1997 | Dittrich | |
| 5,880,397 | A | | 3/1999 | Crilly | |
| 6,158,348 | A | | 12/2000 | Campoli | |
| 6,178,889 | B1 | | 1/2001 | Dindl | |
| 6,415,718 | B1 | | 7/2002 | Saxby | |
| 6,439,123 | B1 | | 8/2002 | Dionne et al. | |
| 6,564,719 | B2 | | 5/2003 | Saxby | |
| 6,625,916 | B1 | | 9/2003 | Dionne | |
| 6,931,978 | B1 | | 8/2005 | Dionne | |
| 7,207,276 | B1 | | 4/2007 | Dindl | |
| 7,225,741 | B2 | | 6/2007 | Huffman | |
| 7,278,358 | B2 | | 10/2007 | Huffman | |
| 7,500,433 | B1 | | 3/2009 | Forrester | |
| 7,621,208 | B2 | | 11/2009 | Huffman | |
| 7,984,668 | B2 | | 7/2011 | Huffman | |
| 8,146,505 | B2 | | 4/2012 | Huffman | |
| 8,220,393 | B2 | | 7/2012 | Schluckebier et al. | |
| 2002/0195017 | A1 | | 12/2002 | Priimak | |
| 2010/0101444 | A1 | | 4/2010 | Schluckebier et al. | |
| 2010/0236395 | A1 | | 9/2010 | Akhavan | |
| 2010/0269724 | A1 | | 10/2010 | Head et al. | |
| 2011/0252999 | A1 | * | 10/2011 | Carlson et al. | 102/513 |
| 2014/0196625 | A1 | * | 7/2014 | Huffman et al. | 102/444 |

OTHER PUBLICATIONS

Billings, "High Velocity Ignition System for Ammunition" U.S. Appl. No. 14/216,130, filed Mar. 17, 2014, and current prosecution history.

* cited by examiner

COMBINATION GAS OPERATED RIFLE AND SUBSONIC CARTRIDGE

PRIORITY CLAIM

The present application claims the benefit of U.S. Provisional Application No. 61/791,807 filed Mar. 15, 2013, which is incorporated herein by reference in its entirety.

FIELD OF THE INVENTION

The invention relates to cartridges for gas operated firearms used by the military, police units, and special operations, and methods of operating said firearms.

BACKGROUND OF THE INVENTION

A common rifle for military and police are gas operated firearms. These include, but are not limited to, AR10, AK-47, AK-74, M14 M16, M16A2, M4, FN SCAR family, M110, MK11, and others. These gas operated rifles have been produced by numerous manufacturers. These weapons, typically shoot, but are not limited to, 5.45 mm, 5.56 mm, 6.8 mm, and 7.62 mm bullets which provide very high bullet velocities.

These gas operated gas operated-style rifles utilize either a direct gas impingement system or a gas and push rod system for operating their ejection and loading mechanisms, in an automatic mode and a semi-automatic mode. The expanding gas from the cartridge propellant is tapped from a port in the barrel intermediate the chamber and the muzzle end of the barrel. In the direct gas impingement system, a conduit extends from the port to the upper receiver and into the region of the bolt carrier. In the gas and pushrod system, the gas impinges against the push rod which extends to the upper receiver and into the region of the bolt carrier. During the initial firing of the cartridge, the bolt is locked into the barrel extension, the gas forces the bolt carrier backward a short distance to unlock the bolt. As the bolt carrier moves toward the butt of the gun, a bolt cam pin, forces the bolt to rotate, by this time the bullet has left the barrel. The inertia of the bolt and bolt carrier continues the rearward motion causing the bolt to extract the fired empty cartridge. A spring absorbs the rearward motion of the bolt and bolt carrier forcing the bolt and bolt carrier forward to engage the next cartridge in the magazine and push same into the chamber ready for firing.

The gas pressures for operating the gas operated style weapons are significant and with the 5.56 mm cartridges the exit velocities, typically in excess of 2700 fps, way exceed the sound barrier (about 1,126 fps). Associated with these velocities are high bullet travel distances, in excess of 2 miles, and noise levels, including from the bullet breaking the sound barrier that cannot be effectively suppressed.

Modifications have been developed for these gas operated weapons to shoot low mass rounds at low velocities that utilize telescoping cartridges-practice ammunition. Typically the cartridges have very low mass, compared to lethal rounds, and may also have frangible projectiles with marking media. The modifications include a bolt and bolt carrier modification that allows the bolt to retract entirely by the propulsion of the expanding telescoping cartridge with no assist from the gas port, effectively changing the function of the weapon from a direct gas impingement system to a direct blowback system. The bolt does not lock into place rearward of the chamber. The energetics in these cartridges is minimal compared to a normal lethal round. For certain manufacturers, the primer contains the entire energetic load for launching the projectile and operating the ejection mechanism by the force from the telescoping cartridge. See Force on Force™ ammunition available from Federal Cartridge Company, the owner of the instant invention. See also U.S. Pat. Nos. 6,931,978; 6,178,889; 6,564,719; 6,625,916; 6,439,123; 5,677,505; 5,492,063; 5,359,937; 6,625,916; 7,278,358; 8,146,505; 7,225,741; 7,621,208; 7,984,668; U.S. Publ. Nos. 2010/0269724.

In certain instances, it would be desirable to have lethal cartridges that may effectively operate the gas operated style ejection mechanism and that travel below the speed of sound. Such cartridges could effectively be mixed with normal high velocity lethal rounds without gun modification. The lower velocity rounds could then be effectively used with suppressors. Attempts to manufacture such ammunition have not yet been entirely successful. For example, simply lowering the amount of propellant to reduce the exit velocity of the bullets results in less gas pressure to reliably operate the weapon. Also, using lower amounts of propellant results in lower ignition pressures, which in turn results in very dirty propellant burn and/or incomplete combustion which causes gun malfunctions. Although weapon modifications are possible to utilize less powerful ammunition, then switching back to the regular full energy ammunition is problematic and certainly cannot reasonably done in a combat situation.

SUMMARY OF THE INVENTION

In a gas operated rifle, low velocity ammunition that travels below the speed of sound and reliably actuates the ejection mechanism without weapon modification utilizes a telescoping cartridge casing with staged propellants in different chambers of the casing.

In an embodiment of the invention, a telescoping cartridge has a forward casing component and a rearward casing component that are slidingly engaged. In an unfired state, they are telescoped together in a retracted state. After firing, the two components remain connected and extended. The forward portion has a reduced diameter neck portion defining a projectile recess that secures the projectile therein, side wall portions therebelow that define, along with the rearward face of the projectile, a forward projectile propellant chamber. The rearward portion of the forward casing component is slidingly engaged with the forward portion of the rearward casing component. The rearward casing component has a rearward end with a primer attached thereto in a primer recess, and a rearward expandable chamber defined above the primer in the rearward casing, defined by side walls of the rearward portion and also defined by a rearward facing surface of the forward casing portion. The rearward chamber expands when the pressure increases therein from the firing of the primer, presuming it is not retained in place, such as by a locked bolt. A conduit having a reduced diameter portion, such as a flashhole, extends between the rearward expandable chamber and the forward casing.

In another embodiment of the invention, a telescoping cartridge has a forward casing component and a rearward casing component that are slidingly engaged. In an unfired state, they are telescoped together in a retracted state. After firing, the two components remain connected and extended. The forward portion has a reduced diameter neck portion defining a projectile recess that secures the projectile therein, side wall portions therebelow that define, along with the rearward face of the projectile, a forward projectile propellant chamber. The rearward portion of the forward casing component is slidingly engaged with the forward portion of the rearward casing component. The rearward casing component has a rearward end with a primer attached thereto in a primer recess. A rearward expandable chamber has propellant therein and is defined by the interface between the forward and rearward casing components. A direct flash pathway is provided to the forward projectile propellant chamber from the primer. The rearward expandable chamber is not directly coupled with a direct flash pathway from the primer. Rather a delay is provided in the ignition of the propellant in the rearward expandable chamber such as by an additional flash pathway from the forward propellant chamber to the rearward expandable chamber.

A feature and advantage of embodiments of the invention is that a telescoping cartridge provides an assist for operating the ejector in a gas operated firearm allowing use of cartridges with less propellant.

In an embodiment of the invention, an AR style gas operated rifle, is operated conventionally utilizing gas bled from the barrel from a fired cartridge to unlock the bolt and the gas and the force from a cartridge telescoping rearwardly is utilized to completely operate the ejection mechanism and to chamber the next cartridge.

In an embodiment of the invention, an AR style gas operated rifle is equipped with a magazine of rounds having both full power non telescoping cartridges, and telescoping cartridges that fire subsonic projectiles. In an embodiment of the invention, an AR style gas operated rifle has a plurality of magazines, one with subsonic cartridges and one with supersonic cartridges which may be operated interchangeably and selectively without modification to the rifle.

In an embodiment of the invention, an AR style gas operated rifle, is operated initially utilizing gas bled from the barrel from a fired cartridge to at least unlock the bolt and the force from a rear component of a cartridge telescoping rearwardly is utilized to operate the ejection mechanism and to chamber the next cartridge.

In an embodiment of the invention, an AR style gas operated rifle is in combination with a telescoping cartridge, the gas cartridge having a projectile and sufficient projectile propellant to unlock the bolt on the chamber of the rifle, the cartridge providing sufficient gas pressure and force provided by the telescoping piston to operate the ejection and chambering mechanism of the rifle.

In embodiments of the invention the amount of projectile propellant utilized in combination with the weight of the projectile, keeps the projectile sub sonic, below the speed of sound. Moreover, the propellant utilized and the telescoping cartridge, provide an unlocking and recycling of the bolt. Also, the energy is maintained to be at least 70 ft-lbs; in other embodiments at least 100 ft-lbs; in other embodiments at least 150 ft-lbs; in other embodiments at least 180 ft-lbs, in other embodiments at least 210 ft-lbs.

In embodiments of the invention, a telescoping cartridge has a forward projectile chamber with projectile propellant and a rearward piston chamber with piston propellant, a primer and ducts that are arranged to first ignite the projectile propellant and then ignite the piston propellant. This delays the peak pressurization of the piston chamber to advantageously utilize same to efficiently drive the piston back after the bolt has been unlocked by the gas from the main propellant charge.

In an embodiment of the invention, a method of operating a gas operated automatic or semi-automatic weapon that has a bolt that locks by a partial rotation of the bolt with respect to a bolt carrier, the bolt carrier in communication with a gas port on the barrel of the weapon, the method comprising utilizing the gas pressure from a cartridge received from a port in the barrel to unlock the bolt, and utilizing the expansion of a telescoping cartridge in the chamber to recycle the weapon after the bolt is unlocked. In embodiments the cartridge is a 5.56 mm cartridge. In embodiments, the propellant driving the projectile does not provide enough gas pressure to recycle the weapon and the telescoping cartridge supplements the needed power for recycling sufficient to accomplish the recycling.

DETAILED DESCRIPTION

Figure 1:
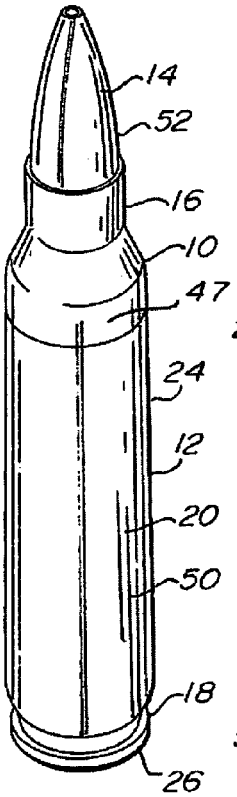
FIG. 1 is a perspective view of a telescoping cartridge in a retracted position in accord with embodiments of the invention herein.
Figure 2:
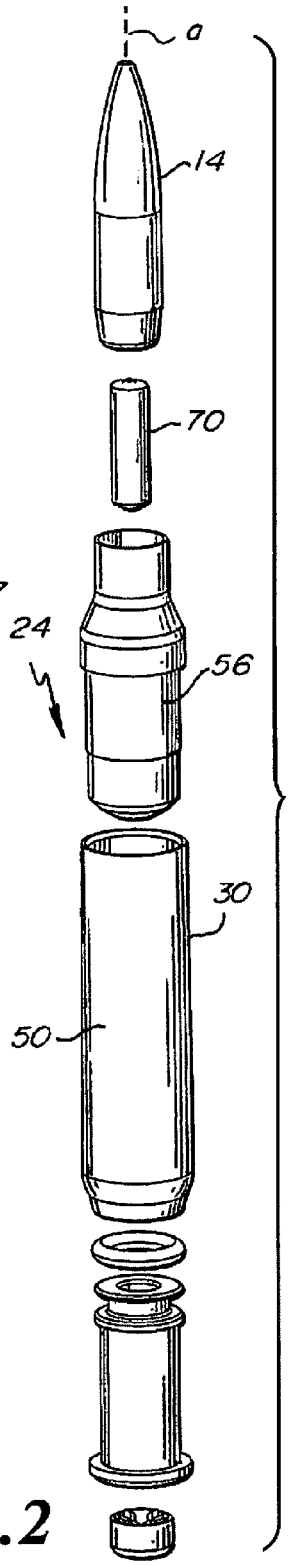
FIG. 2 is an exploded perspective view of a telescoping cartridge in accord with embodiments of the invention.
Figure 3:
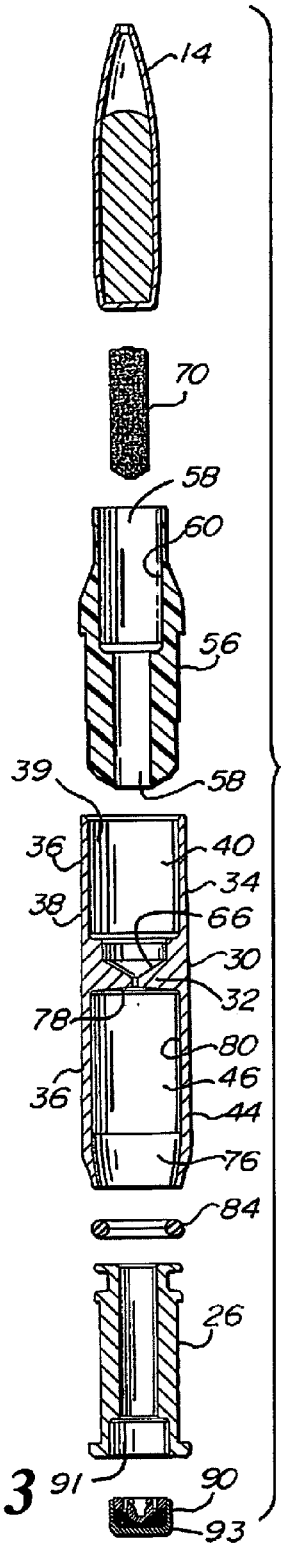
FIG. 3 is an exploded perspective view of the telescoping cartridge of FIG. 2.
Figure 4:
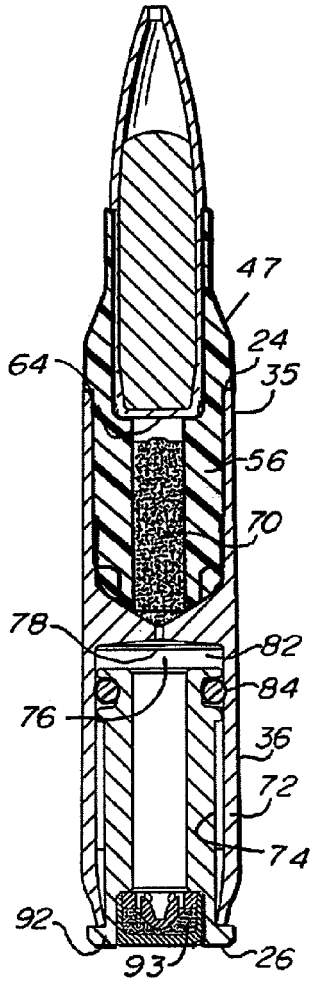
FIG. 4 is a cross sectional view of a telescoping cartridge in accord with embodiments of the invention.
Figure 5:
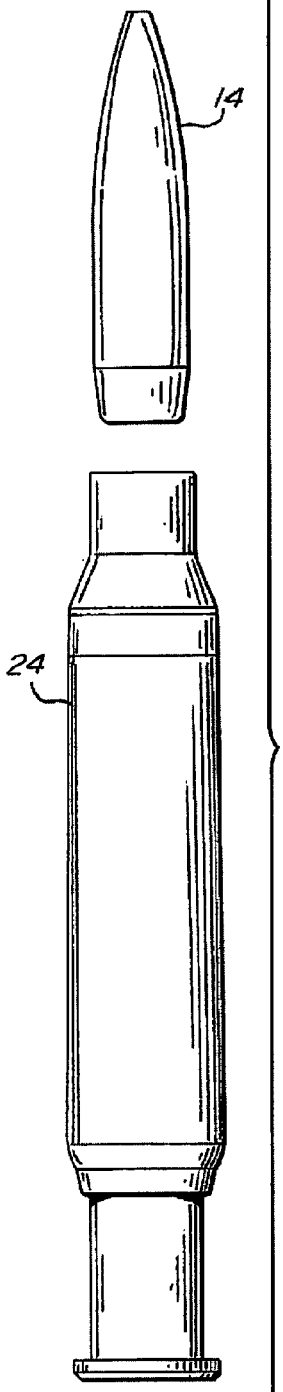
FIG. 5 is an elevational view of the telescoping cartridge of FIG. 4 in an extended state with the projectile having left the casing.
Figure 6:
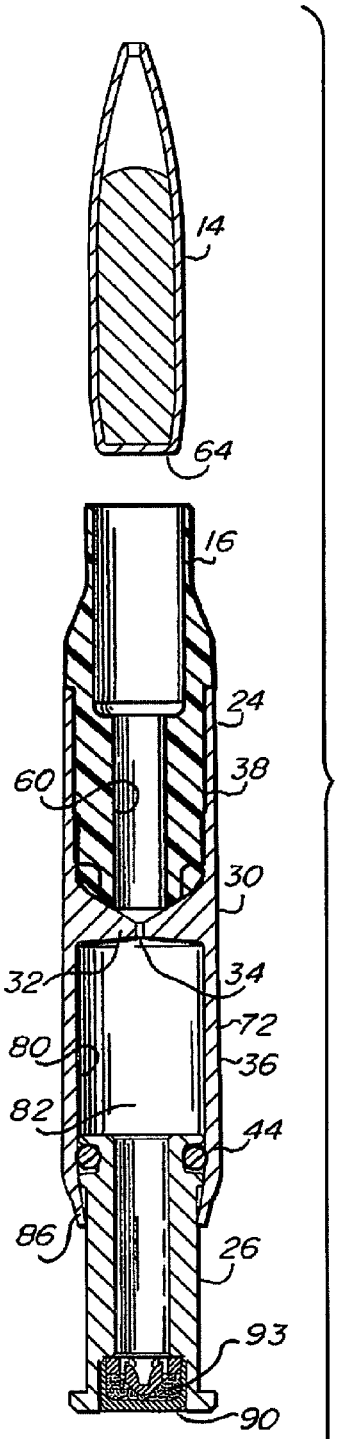
FIG. 6 is a cross sectional view of the telescoping cartridge of FIG. 4 in an extended state with the projectile having left the casing.

Referring to the Figures, various embodiments of a telescoping cartridge 10 suitable for firing in a rifle with a gas operated ejection and chambering mechanism. The cartridge comprises generally a casing 12 and a projectile 14. The casing has a reduced neck portion 16 and a flange utilized by the ejection mechanism, and a casing body 20. The casing is further comprised of a forward component 24 and a rearward component 26 that are slidably engaged and extend axially upon the cartridge being fired. The forward component may be comprised of a H-shaped, in cross section, tubular section defining a housing 30 having a central narrowed or bridging portion 32 with a passage way therethough configured as a flashhole 34. The tubular section may be formed of convention metals such as brass or aluminum or other suitable materials such as polymers. A forward portion 35 of the forward component has exterior walling 36 comprising an axially extending forward wall portion 38 defining a recess 39 and an interior duct 40, and an exterior axially extending rearward wall portion 44 defining an interior duct 46. The interior duct has a first rearward portion that is cylindrical bore and a wider cylindrical recess thereabove for receiving the bullet or projectile 14. The two ducts are in communication with each other through the flash hole 34. The exterior walling has an exterior surface 50 with a taper going toward the forward end 52 of the bullet. The forward component is further comprised, in this embodiment, of an insert 56 seated permanently in the recess 39. The insert may be formed of a polymer, such as nylon, various metals such, as aluminum, or ceramic materials or other suitable materials. The insert has an opening or axial duct 58 defined by an interior wall surface 60 in the recess.

The interior wall surface 60, the tail end surface 64 of the projectile and the surface 66 of the bridging or narrowed portion 32 surrounding the flashhole form a projectile expansion chamber 68 and includes propellant 70.

A rearward portion 72 of the forward component has the walling 36 with side walls 72 with interior wall surfaces 74 defining a piston chamber 76 into which the rearwardly component 26, configured as a piston, is slidingly received. The rearwardly facing wall surface 78 of the narrowed or bridging portion and the inside facing wall surfaces 80 and the piston, define a primer expansion chamber 82. The rearward component comprises the piston and the flange and the primer 90. An O-ring 84 may facilitate sealing of the piston in the cylinder defined by the rearward portion of the forward component. The ends 86 of the side walls may be crimped for retaining the piston in the cylinder after retraction. The primer 90 may be conventional and is received and retained in a recess 91 in the rearward end 92 of the piston.

Figure 7:
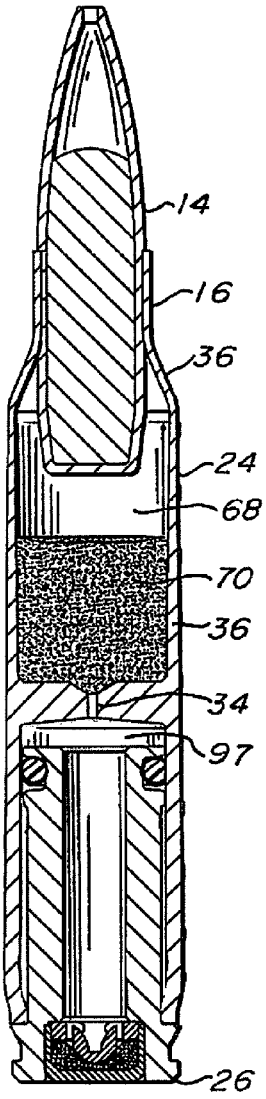
FIG. 7 is a cross sectional view of a telescoping cartridge in accord with embodiments of the invention.
Figure 8:
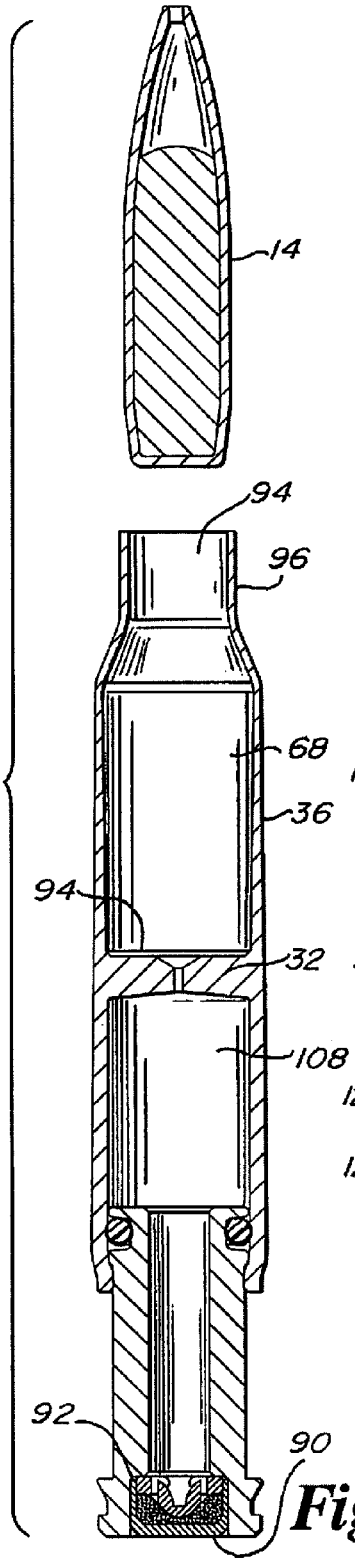
FIG. 8 is a cross sectional view of the telescoping cartridge of FIG. 7 in an extended state with the projectile having left the casing.

Referring to FIGS. 7 and 8, a further embodiment of the invention is illustrated. The forward component 24 has the narrowed neck portion as integral or unitary with the walling 36. The projectile propellant expansion chamber 68 is defined by the top surface 94 of the bridging portion 32, the side walls, and the projectile 14. The propellant 70 for the projectile 14 is positioned above the flash hole 34 in the chamber 68. The projectile is seated in the recess 94 defined by the neck portion 96. The primer expansion chamber is configured as described in FIGS. 1-4.

Figure 9:
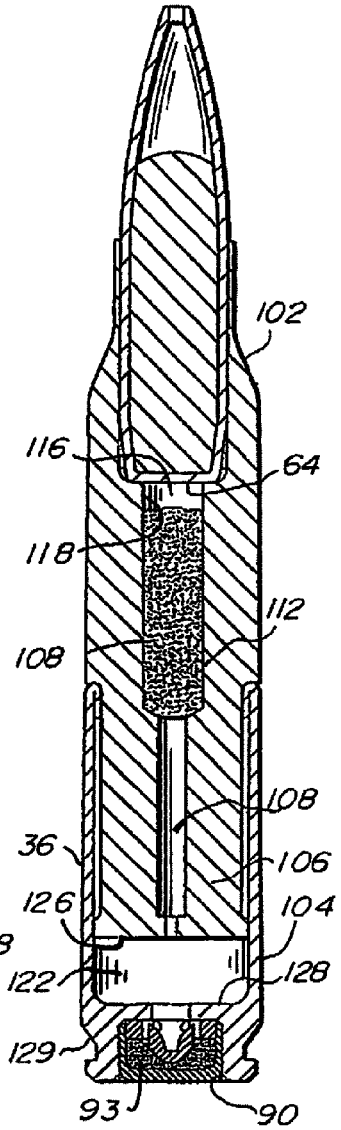
FIG. 9 is a cross sectional view of a telescoping cartridge in accord with embodiments of the invention.

FIG. 9 illustrates a further embodiment wherein the forward component 102 is inserted into the rearward component 104, that is, the rearward portion 106 of the forward component is configured as a piston and the rearward component is the cylinder. The forward component may be formed from a polymer, such as nylon. Other materials may be suitable. Similar to the previous embodiments, an axial pathway 108 or duct runs the entire length of the casing between the primer and the projectile 14. The narrowest portion of the duct being at the flashhole 34. At a widened portion 112, the projectile propellant is placed, just behind, rearward of, the projectile. The projectile propellant expansion chamber 116 is defined by the rearward surface 64 of the projectile, and the walling, specifically the inside surface 118 of the duct 108. The primer expansion chamber 122 is defined by the rearward face 126 of the piston, the walling 36, and the forward facing surface 128 of the end portion of the rearward component.

In embodiments, the above configurations have propellant and projectile weights matched to be between about 80 and 280 ft-lbs of energy whilst maintaining bullet speed at subsonic levels. In other embodiments, between 60 and 300 ft-lbs at subsonic levels. In other embodiments, between 300 and 670 ft-lbs of energy. The weight of the projectiles, the bullets will weigh between 40 and 120 grains. In other embodiments between 60 and 140 grains. In other embodiments between 70 and 120 grains. In other embodiments between 120 and 300 grains. In other embodiments for other calibers.

The above embodiments function as conventional ammunition in gas operated rifles such as the AR-15 and M16A2 designs. When the round is chambered, the bolt is locked in place by a partial rotation, the firing pin ignites the primer which pressurizes the rearward or primer chamber and a gas jet passes through the flashhole igniting the projectile propellant. Ignition of the projectile propellant launches the projectile and provides a high pressure wave of gas behind the projectile as it travels down the barrel. The pressurized gas enters the port in the barrel to return to the upper receiver to drive back the cammed bolt carrier which partially rotates the bolt to unlock it. The pressurization of the rearward chamber then allows the piston to be driven rearwardly in driving or assisting in driving the bolt rearwardly to eject the cartridge. The bolt cycles back to chamber another round. See U.S. Pat. No. 6,931,978 which is incorporated by reference. Significantly, the advantages of a telescoping practice round is being utilized to cause recycling of the ejection chambering mechanism in the presence of the bolt lock. In previously known gas operated rifles, the bolt was replaced with a non-locking bolt to allow retraction of the bolt by the much lesser energy charges associated with practice ammunition.

In embodiments of the invention, the propellant utilized in the primer and/or projectile propellant are slow burning sufficient to maintain sufficient pressurization of the piston and cylinder until the bolt is unlocked by the pressure transferred from the barrel to recycle the weapon.

Figure 10:
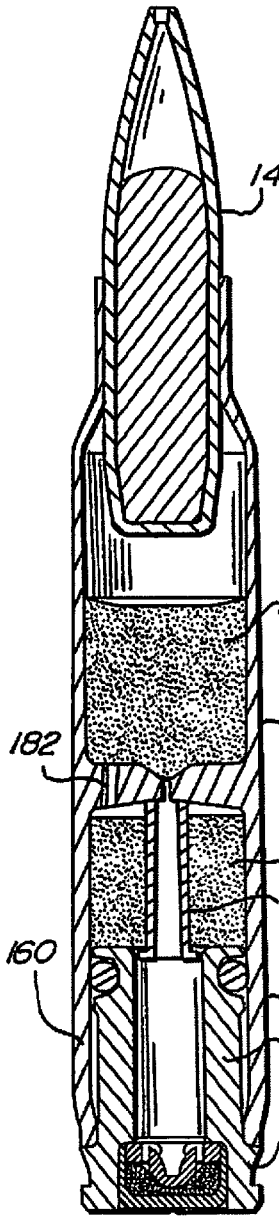
FIG. 10 is a cross sectional view of a telescoping cartridge in accord with embodiments of the invention.
Figure 11:
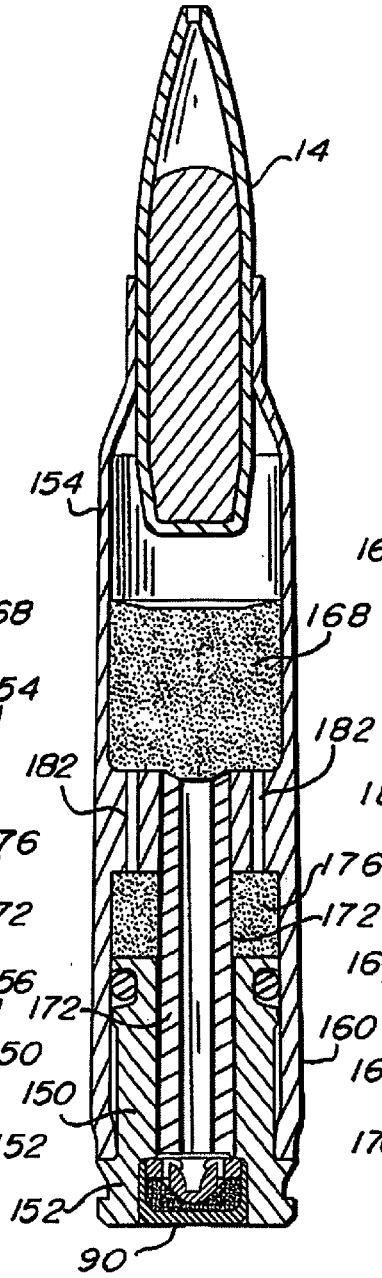
FIG. 11 is a cross sectional view of a telescoping cartridge in accord with embodiments of the invention.
Figure 12:
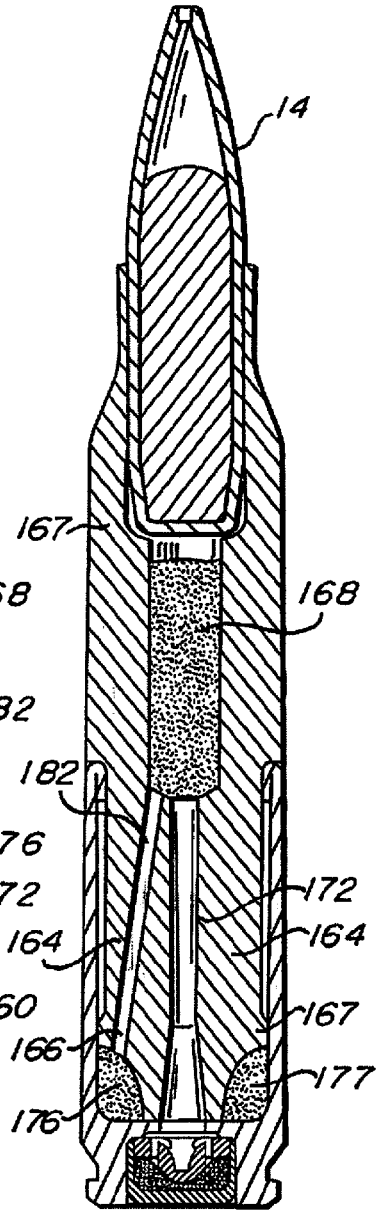
FIG. 12 is a cross sectional view of a telescoping cartridge in accord with embodiments of the invention.

Referring to FIGS. 10-12, additional embodiments are illustrated. FIGS. 10 and 11 utilize a piston 150 as the rearward component 152 of the two slidingly engaged components of the telescoping cartridge. The forward component 154 includes the cylinder 156 at its rearward portion 160. FIG. 12 is an embodiment where the piston 164 is defined by the rear portion 166 of the forward component 167, similar to the embodiment of FIG. 9 above. In the embodiments of FIGS. 10-12, the forward projectile propellant 168 is ignited first to launch the projectile 14. The ignition from the primer 90 is transferred by way of a flash tube 172 past the rearward piston chamber 176 so that the piston chamber does not pressurize or significantly pressurize. The ignition of the main or forward projectile propellant launches the projectile which allows the pressurized gas to travel down the barrel and enter the return port to pressurize and partially retract the bolt carrier which unlocks the bolt. The ignition of the main projectile propellant then provides burning gas through the orifices or reverse secondary flash passage ways 182 to the rearward piston chamber igniting the piston chamber propellant with some delay from when the main projectile propellant was ignited. This delay allows the unlocking of the bolt before the peak pressurization of the piston chamber, or before significant dissipation of the pressurization. In embodiments, the passageways can have propellant therein. The propellants are suitably selected to provide proper timing of pressurizations and level of pressurizations.

Figure 13A:
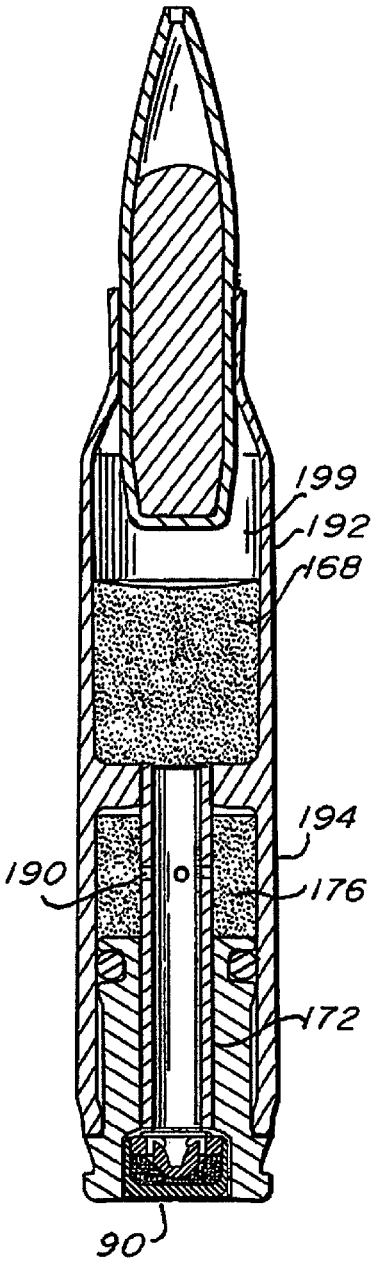
FIGS. 13A and 13B are cross sectional views of a telescoping cartridge in accord with embodiments of the invention.
Figure 13B:
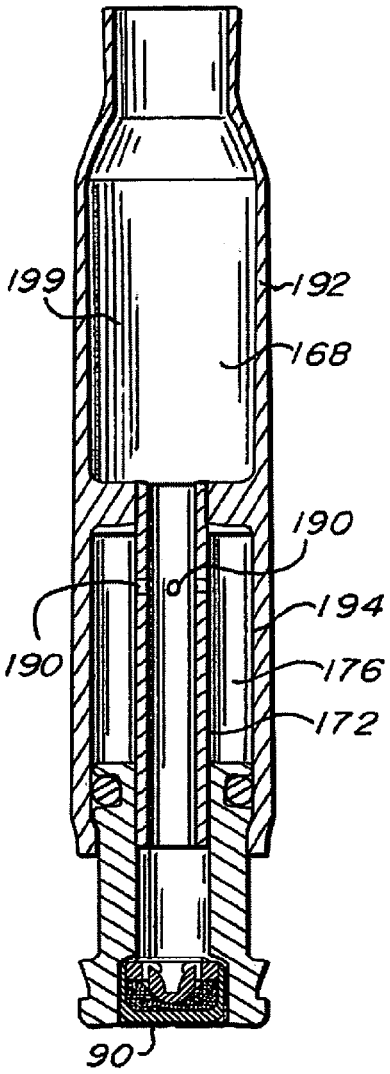

FIGS. 13A and 13B illustrate an embodiment with apertures 190 in the flash tube 172 extending between the projectile propellant chamber 199 and the primer 90. In this embodiment there is a delay in the pressurization of the casing expansion chamber in that there is not a direct pathway to the propellant 176 in the expansion chamber 194 to the primer. Thus the initial jet from the primer impacts the projectile propellant but bypasses the expansion chamber propellant but the propellant is eventually ignited.

Figures 14A, 14B, 14C:
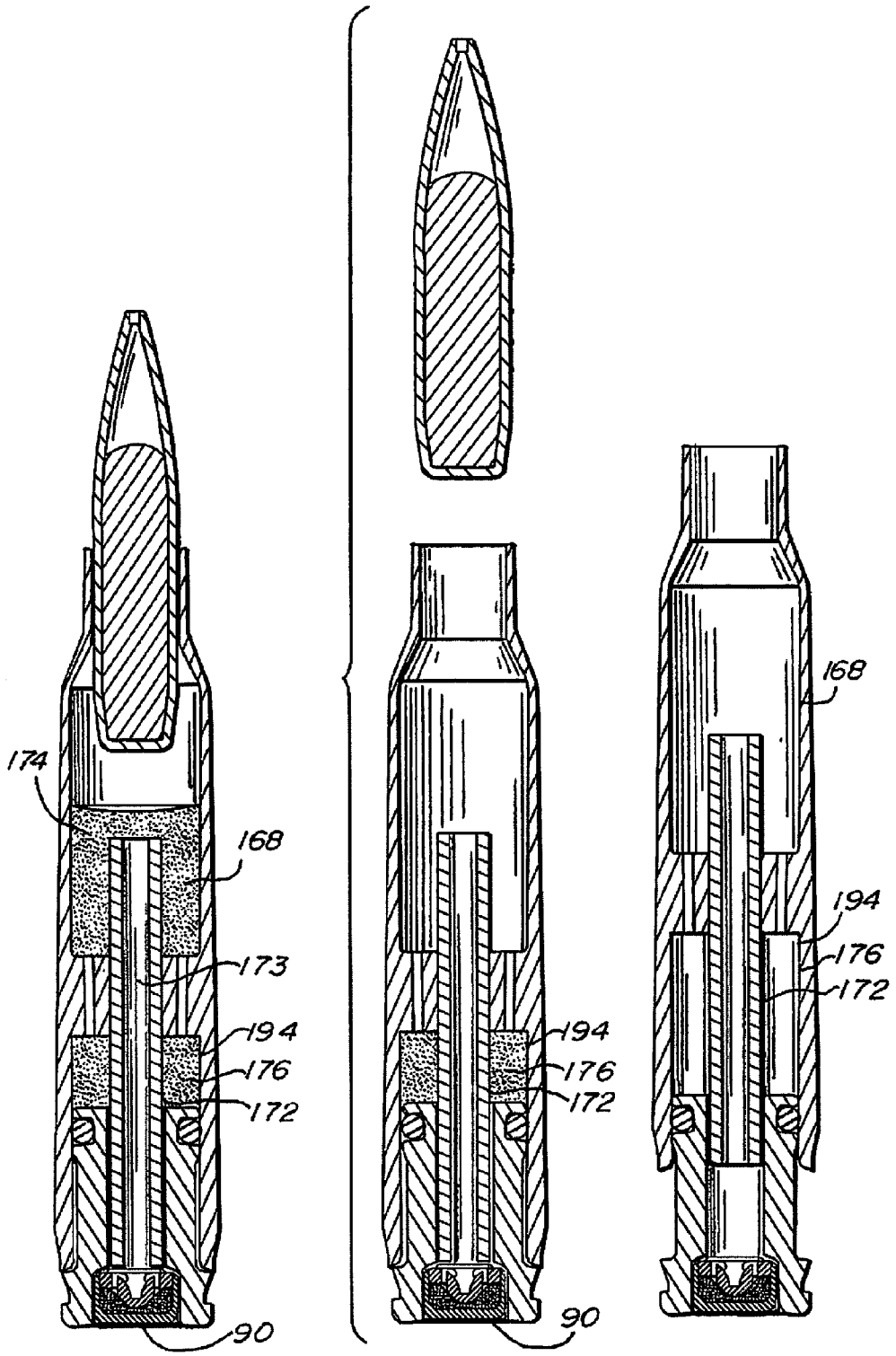
FIGS. 14A, 14B, and 14C are cross sectional views of a telescoping cartridge in accord with embodiments of the invention.

FIGS. 14A, 14B, and 14C illustrate a further embodiment where the flash tube 172 extends into an upper region of the projectile propellant chamber which will cause the burn of the main projectile propellant to be rearwardly, delaying the flash extending to the propellant chamber igniting the propellant. Other embodiments do not have propellant in the casing expansion chamber but utilize a delayed transfer of pressure, for example from the main projectile chamber as illustrated in FIGS. 14A, 14B, and 14C. Thus an embodiment is as illustrated in FIGS. 14A, 14B, and 14C without the propellant 176.

Figure 15:
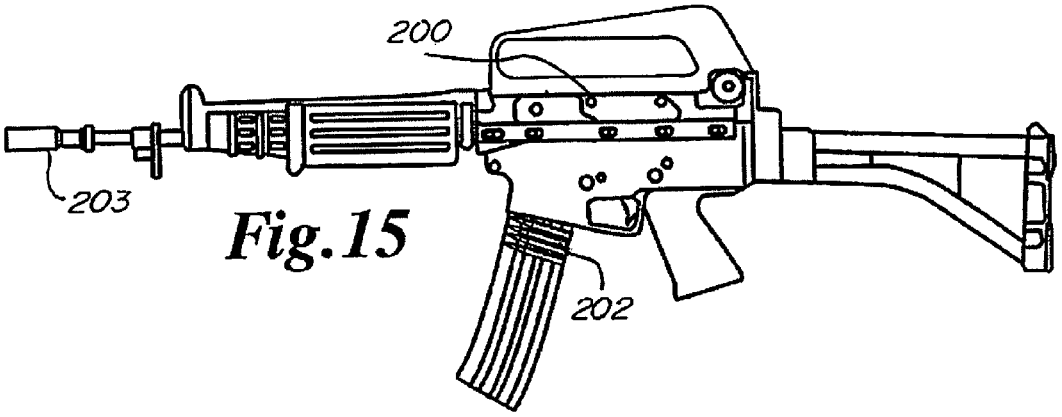
FIG. 15 is a gas operated rifle in combination with telescoping cartridges and a suppressor in accord with the inventions herein.

FIG. 15 illustrates a gas operated rifle, such as an AR-15, that has a magazine with telescoping cartridges and a suppressor. The combination may fire bullets with subsonic speed with lethal energy levels and still properly recycle the ejection and chambering mechanisms.

Apparatus and methods of operating gas operated rifles and cartridges, including telescoping cartridges are disclosed in the following patents and publications which are hereby incorporated by reference herein in there entireties: U.S. Pat. Nos. 6,931,978; 6,178,889; 6,564,719; 6,625,916; 6,439,123; 5,677,505; 5,492,063; 5,359,937; 6,625,916; 7,278,358; 8,146,505; 7,225,741; 7,621,208; 7,984,668; U.S. Publ. Nos. 2010/0269724.

The above references in all sections of this application are herein incorporated by references in their entirety for all purposes.

All of the features disclosed in this specification (including the references incorporated by reference, including any accompanying claims, abstract and drawings), and/or all of the steps of any method or process so disclosed, may be combined in any combination, except combinations where at least some of such features and/or steps are mutually exclusive.

Each feature disclosed in this specification (including references incorporated by reference, any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment (s). The invention extends to any novel one, or any novel combination, of the features disclosed in this specification (including any incorporated by reference references, any accompanying claims, abstract and drawings), or to any novel one, or any novel combination, of the steps of any method or process so disclosed The above references in all sections of this application are herein incorporated by references in their entirety for all purposes.

Although specific examples have been illustrated and described herein, it will be appreciated by those of ordinary skill in the art that any arrangement calculated to achieve the same purpose could be substituted for the specific examples shown. This application is intended to cover adaptations or variations of the present subject matter. Therefore, it is intended that the invention be defined by the attached claims and their legal equivalents, as well as the following illustrative aspects. The above described aspects embodiments of the invention are merely descriptive of its principles and are not to be considered limiting. Further modifications of the invention herein disclosed will occur to those skilled in the respective arts and all such modifications are deemed to be within the scope of the invention.

We claim:

1. A telescoping cartridge comprising:

a piston component slidably engaged with a cylinder component, one of the components defining a projectile recess with a projectile therein, and a projectile propellant chamber rearwardly thereof with projectile propellant therein, the other component defining a primer recess with a primer therein, and a piston chamber defined by the piston component and the cylinder component, the piston chamber having piston chamber propellant therein, the primer in communication with the projectile propellant via a passageway, the primer not in direct communication with the piston chamber, the piston chamber in communication with the projectile propellant chamber.

2. The cartridge of claim 1 wherein the projectile weighs at least 40 grains.

3. The cartridge of claim 1 wherein when the primer ignites, the projectile propellant then ignites and then the piston chamber propellant ignites.

4. A gas operated rifle in combination with a telescoping cartridge, the cartridge comprising a telescoping casing having a forward projectile chamber with a projectile weighing at least 40 grains therein, projectile propellant rearward of and in direct communication with the projectile, the telescoping casing further having a rearward piston chamber with piston propellant, the telescoping casing further having a primer recess with a primer therein, and ducts that are arranged to first ignite the projectile propellant from the primer, and then ignite the piston propellant thereby delaying the peak pressurization of the piston chamber whereby the bolt of the rifle can be unlocked by the projectile propellant and then the piston can operate to recycle the weapon.

5. A cartridge comprising a telescoping casing and projectile weighing at least 40 grains, the casing comprising a forward projectile chamber with projectile propellant therein, a rearward expansion chamber with casing expansion propellant for extending the telescoping cartridge, a primer, and a means for delaying the pressurization of the rearward expansion chamber.

6. The cartridge of claim 5 wherein the means comprises structure isolating the rearward expansion chamber from the direct flash path way of the primer.

7. The cartridge of claim 6 wherein the means further comprises structure providing a path way from the forward projectile chamber to the rearward expansion chamber.

8. The cartridge of claim 7 further comprising propellant in the rearward expansion chamber and the path way from the forward projectile chamber to the rearward expansion chamber is a direct flash path way.

9. A combination gas operated rifle and a cartridge operable in the rifle, the cartridge comprising a telescoping casing and projectile weighing at least 40 grains, the casing comprising a forward projectile chamber with projectile propellant therein, a rearward expansion chamber with casing expansion propellant therein for extending the telescoping cartridge, and a primer, a means for delaying the pressurization of the rearward expansion chamber, wherein the means comprises structure isolating the rearward expansion chamber from the direct flash path way of the primer and structure providing a flash path way from the forward projectile chamber to the rearward expansion chamber.

10. The combination of claim 9, wherein the propellant in the forward projectile chamber is sufficient to fire the projectile with at least 80 ft-lbs of energy.

11. The combination of claim 9 where the propellant in the forward projectile chamber is sufficient to fire the projectile with at least 300 ft-lbs of energy.

* * * * *